United States Patent [19]

Nye

[11] Patent Number: 4,731,976

[45] Date of Patent: Mar. 22, 1988

[54] METHOD AND APPARATUS FOR APPLYING AN ELASTIC SLEEVE ON AN ARTICLE

[76] Inventor: Norman H. Nye, 1348 Highbridge Rd., Cuyahoga Falls, Ohio 44223

[21] Appl. No.: 36,129

[22] Filed: Apr. 6, 1987

Related U.S. Application Data

[63] Continuation of Ser. No. 897,586, Aug. 18, 1986, abandoned.

[51] Int. Cl.[4] ..... B65B 11/00

[52] U.S. Cl. ..... 53/399; 53/441; 53/556; 53/585; 53/291

[58] Field of Search ..... 53/585, 399, 291, 292, 53/441, 556

[56] References Cited

U.S. PATENT DOCUMENTS 4,387,553 6/1983 Strub ..... 53/585

4,480,536 11/1984 Burns ..... 53/585 X

*Primary Examiner*—John Sipos

*Attorney, Agent, or Firm*—Oldham, Oldham & Weber Co.

[57] ABSTRACT

This invention relates to a method and apparatus for applying a strong elastic sleeve on an article. Especially if the elastic sleeve is very strong and the article is somewhat fragile. It is intended for the container industry, but may have other uses.

13 Claims, 17 Drawing Figures

METHOD AND APPARATUS FOR APPLYING AN ELASTIC SLEEVE ON AN ARTICLE

This application is a continuation of Ser. No. 897,586 filed Aug. 15, 1986, now abandoned.

FIELD OF THE INVENTION

This invention relates particularly to the container industry and more particularly to containers of the aerosol type. However, it may have other fields of use.

BACKGROUND ART

The common aerosol type of container uses gas under pressure to propell the contents out of the container when a valve is actuated.

The type of container for which this method and apparatus is designed, uses an elastic sleeve to obtain the pressure needed rather than a gas. Such a container is described in U.S. Pat. No. 4,423,829, issued to Hyman Katz.

The elastic sleeve is usually made of rubber and has an inside diameter much smaller than the diameter of the container on which it is applied, and the wall of the elastic sleeve is quite thick. It requires considerable force to expand the elastic sleeve in order to apply it to the outside of the container. The container is usually made of thin film and must be carefully manipulated, so as not to damage it while applying the sleeve.

The method and apparatus used to date to apply the sleeve to the container has been complicated and expensive and has not been entirely successful for the purpose.

This invention provides a satisfactory means to accomplish the application of the sleeve to the container. This invention is not limited to the use shown here.

DETAILED DESCRIPTION

Figure 1:
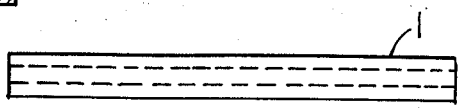
FIG. 1 is a side view of an elastic sleeve of the type for which this invention applies.
Figure 2:
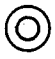
FIG. 2 is an end view of the elastic sleeve shown in FIG. 1, showing the approximate proportions of inside diameter to outside diameter and has been drawn to the same scale as the container shown in FIG. 3 to which it is to be applied.

FIG. 1 shows an elastic sleeve such as is to be applied to a container 2 shown on FIG. 2.

Figure 6:
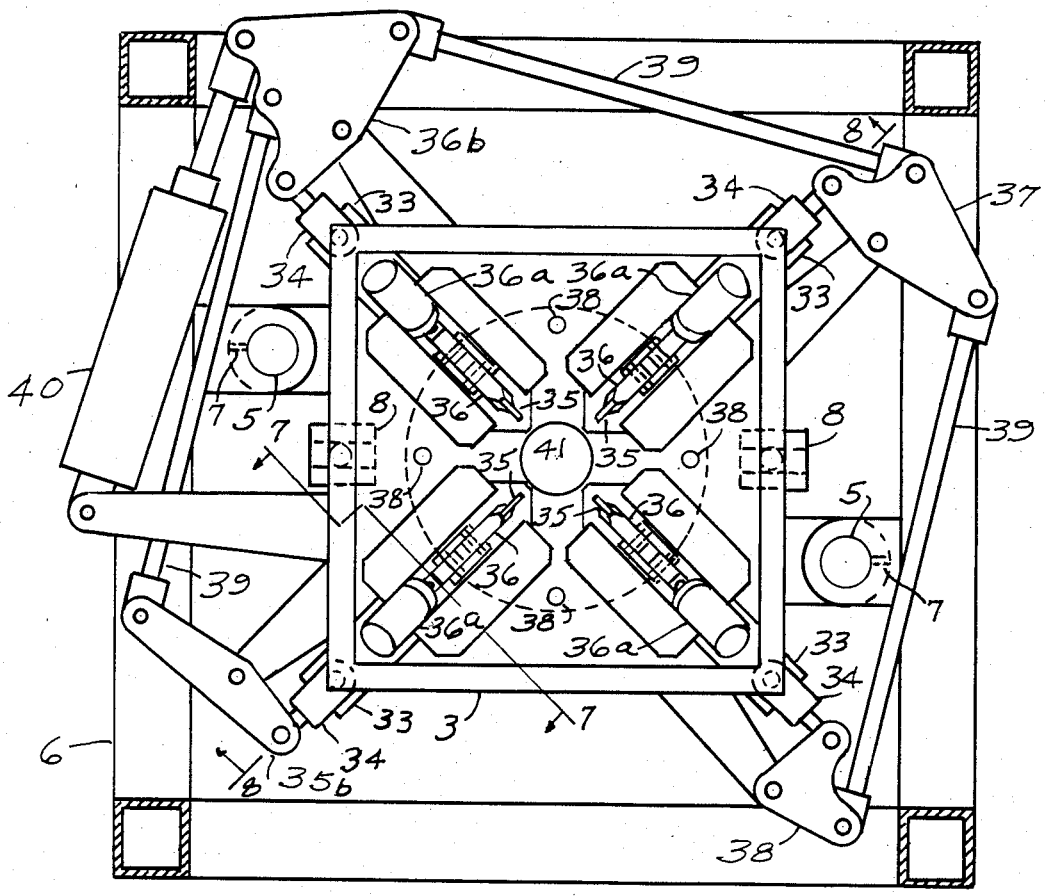
FIG. 6 is a view on line 6—6 of FIG. 15. This view would also be nearly identical to a mirror image of a view taken on line 6A—6A of FIG. 15. All components shown in both views would be alike, except for a linkage connection.
Figure 7:
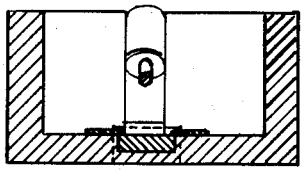
FIG. 7 is a section taken on line 7—7 of FIG. 6.
Figure 5:
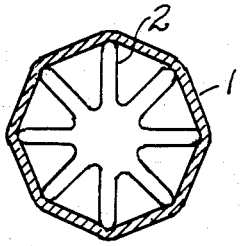
FIG. 5 is an enlarged section on line 5—5 of FIG. 4.
Figure 3:
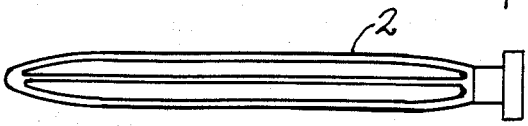
FIG. 3 illustrates a typical container to which the elastic sleeve is to be applied.
Figure 4:
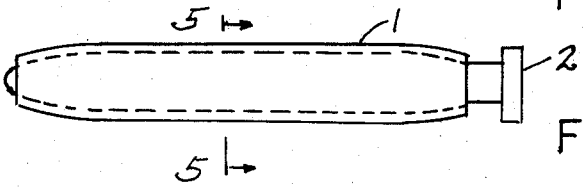
FIG. 4 shows a container after an elastic sleeve has been applied.
Figure 8:
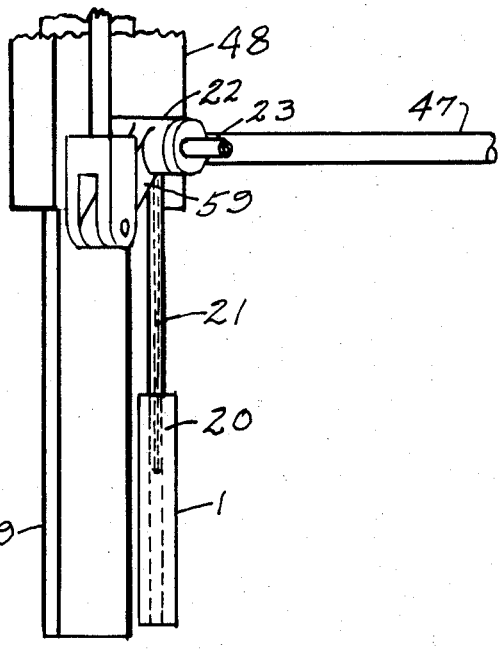
FIG. 8 is a section taken on line 8—8 of FIG. 6.
Figure 8:
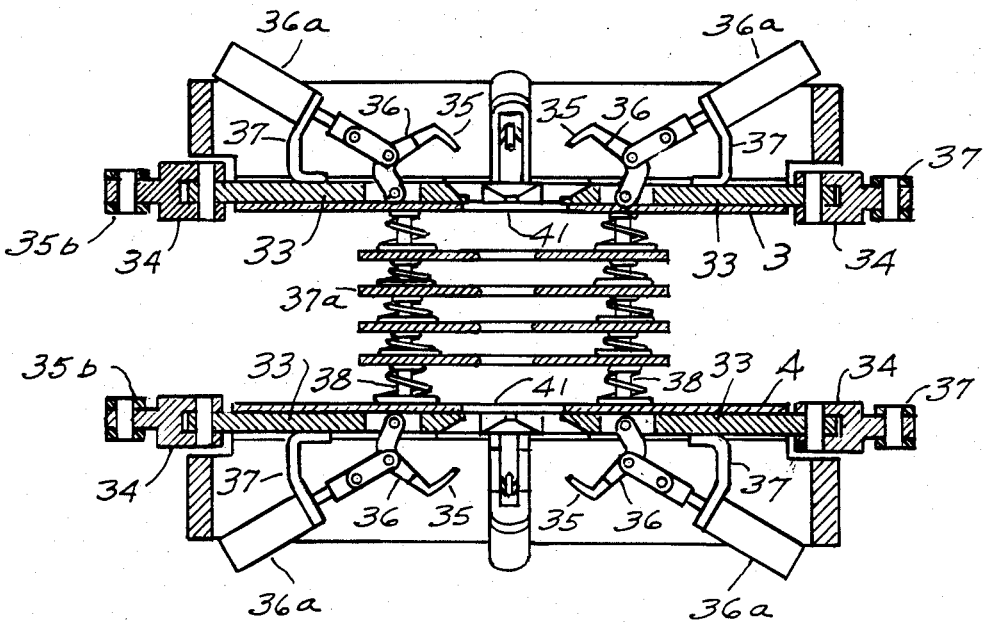
Figure 8:
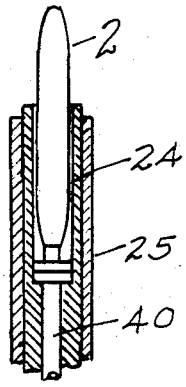

FIG. 3 shows a container 2 on which an elastic sleeve 1 has been applied. The elastic sleeve 1 is usually made of natural rubber of the type known as pure gum. The container 2 is usually made by the blow molding process and is made of thin plastic film and is corrugated as shown in section on FIG. 5. Referring to FIGS. 6 and 8, there are two end plates, one upper end plate 3 and a lower end plate 4. Both end plates 3 and 4 are mounted on a pair of slide rods 5. The slide rods are attached at the ends to frame 6. The upper plate 3 is fixed in place and held by set screws 7. The lower plate 4 slides on slide rods 5 and is moved in a vertical direction by two links 8, and two levers 9, that are attached to shaft 10. Also, attached to shaft 10 is a central lever 11, that is connected by links 12 to a lever 13, that is pivoted on shaft 14. One arm of the lever 13 has a cam roller 14*a* that is in contact with cam 15. The cam 15 is attached to cam shaft 16, which is rotated by means of belt pulley 17 and belt 18, and motor drive unit 19.

Refer again to FIG. 8. There is an arbor 20, arranged to receive the elastic sleeve and it fits the inside diameter of the elastic sleeve, tight enough to retain the elastic sleeve without it falling off. The arbor 20 is tubular, and it has a passage 21 through its axis for the passage of fluid. The arbor is attached pivotably to a rotating joint 22, to which is connected a tube 23, which in turn is connected to a source of fluid pressure (not shown).

A tubular receptacle 24 is provided to receive a container 2, placed there by an operator. The receptacle 24 is slidable, mounted in slotted tube 25 that is attached to frame 6, by supports 26. The tubular receptacle is moved vertically by means of links 27, and lever 28 that is pivoted on shaft 29 and has extension lever 30 attached thereto on which is mounted cam roller 31 that is in contact with cam 32. Spring 32*a* assists in keeping the cam roller 31 in contact with the cam 32.

Referring to FIG. 8, the upper plate 3 and the lower plate 4, each have four slide elements 33. The said slide elements 33 have shaped ends arranged for pinching the ends of the elastic sleeve so it may be expanded by fluid pressure. The slide elements 33 in the upper plate 3 pinch the elastic sleeve 1 against the arbor 20, whereas the slide element 33 in the lower plate 4 pinch the elastic sleeve against itself with nothing in the inside diameter.

Refer to FIG. 6. The movement of the slide elements 33 in a direction towards or away from the axis of the arbor 20 is actuated by links 34, lever 35*b*, 36*b*, 37 and 38, and links 39 and air cylinders 40. Both end plates 3 and end plates 4 have identical actuating apparatus for the slide elements 33.

The slide elements 33 are slotted and carry pivoted prong levers 36, said prong levers have attached integral therewith prongs 35 of a diameter small enough so that the four prongs 35 will fit into the inside diameter of the ends of the elastic sleeve 1, that are not expanding sufficiently by the fluid pressure. The prong levers are actuated by air cylinders 36*a*, that are also attached to slide elements 33, by bracket 37.

Spaced between end plates 3 and 4 are a number of intermediate plates 37*a* which are carried on rods 38, said rods 38 are fitted tight in lower plate 4, but slide in holes in upper plate 3. The intermediate plates 37*a* are spaced apart at the desired distance by spiral springs 39. Certain of the spiral springs may be made stronger than others to help control the rate of collapse of the elastic sleeve. The end plates 3 and 4 and the intermediate plates 37*a* all have a central hole 41, that is of a size somewhat larger than the container 2. The size of the hole 41 is determined by the clearance needed for inserting the container 2 into the expanded elastic sleeve.

The receptacle 24 is tubular and carries an ejector rod 40 through its inside diameter. The ejector rod is actuated by means of links 31, cam lever 42, that is pivoted on shaft 43 to which is attached lever 44, cam roller 45 that is in contact with cam 46.

A cooperating ejector 47 with a concave end 48 is attached to the rotating joint at a point approximately 90° to the attachment of the arbor 20. The rotating joint 22 is mounted pivotably on a sliding block 48 that slides on a flat bar 49. The flat bar 49 is attached by supports 50 to frame 6. The sliding block 48 is moved in a vertical direction by means of links 51, lever 52. link 53, lever 54, and lever 55, which carries cam roller 56 that contacts cam 57. A spring 58 is provided to overcome the weight of the sliding block 48 and keep the cam roller 56 in contact with cam 57. The arbor 21 and ejector 47 are pivoted and selectively brought into the proper position as needed in the machine cycle by air cylinders 58 and lever 59.

THE OPERATION OF THE APPARATUS

Figure 9:
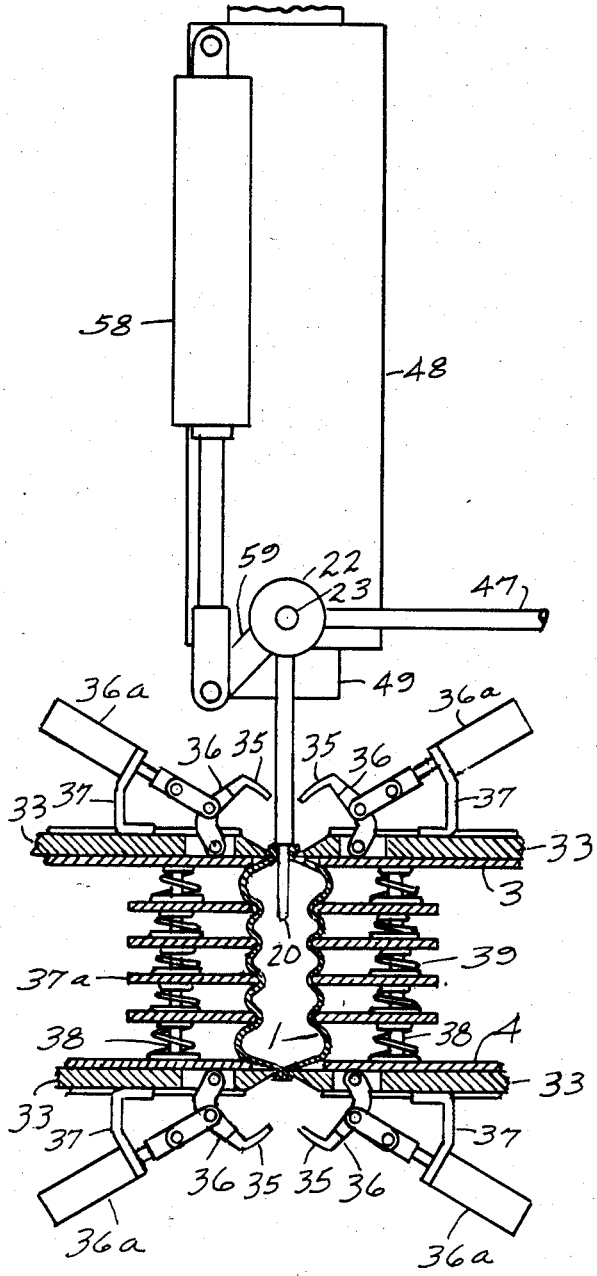
FIGS. 9, 10, 11, 12, 13 are diagramatic views, partly in section, to show successive stages in the process of applying the elastic sleeve to the container.
Figure 9:
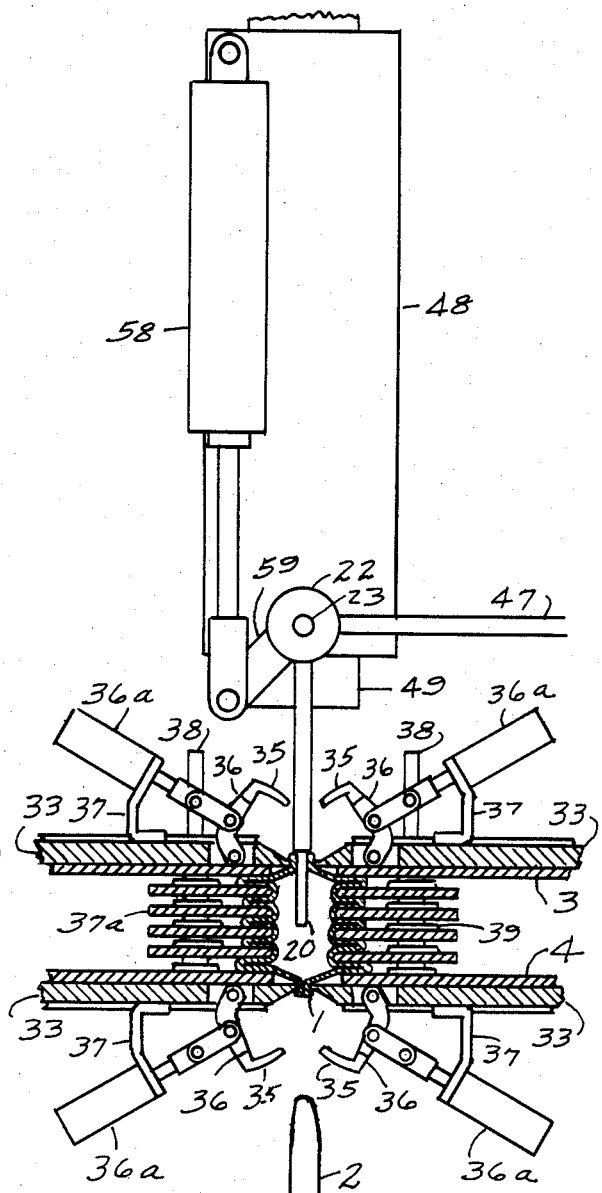
Figure 9:
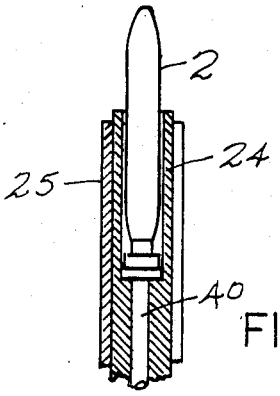
Figure 10:
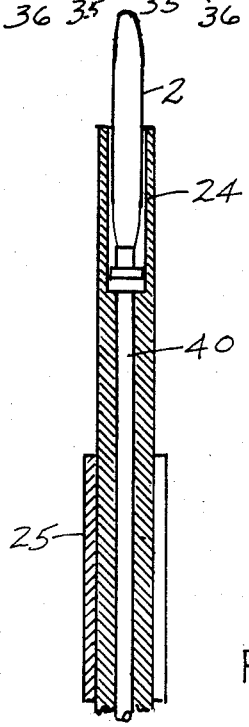

An elastic sleeve is placed on the arbor 20 and a container 2 is placed in the receptacle 24 by an operator, or this can be done by a robot or other mechanical means. The arbor 20 then moves into a position illustrated in FIG. 9, where the elastic sleeve 1 is pinched and expanded by fluid pressure fed through passage 21 into the interior of elastic sleeve 1. The elastic sleeve 1 is expanded to the extent that it contacts the holes in plates 3, 4, and 37*a*, and bulges into the spaces between the plates. Plate 4 then moves vertically to a position shown in FIG. 10, to compress the bulges in the elastic sleeve 1 with enough force to maintain the elastic sleeve 1 in the expanded state, then the fluid pressure is released and the arbor 20 is retracted to its initial position.

Figure 11:
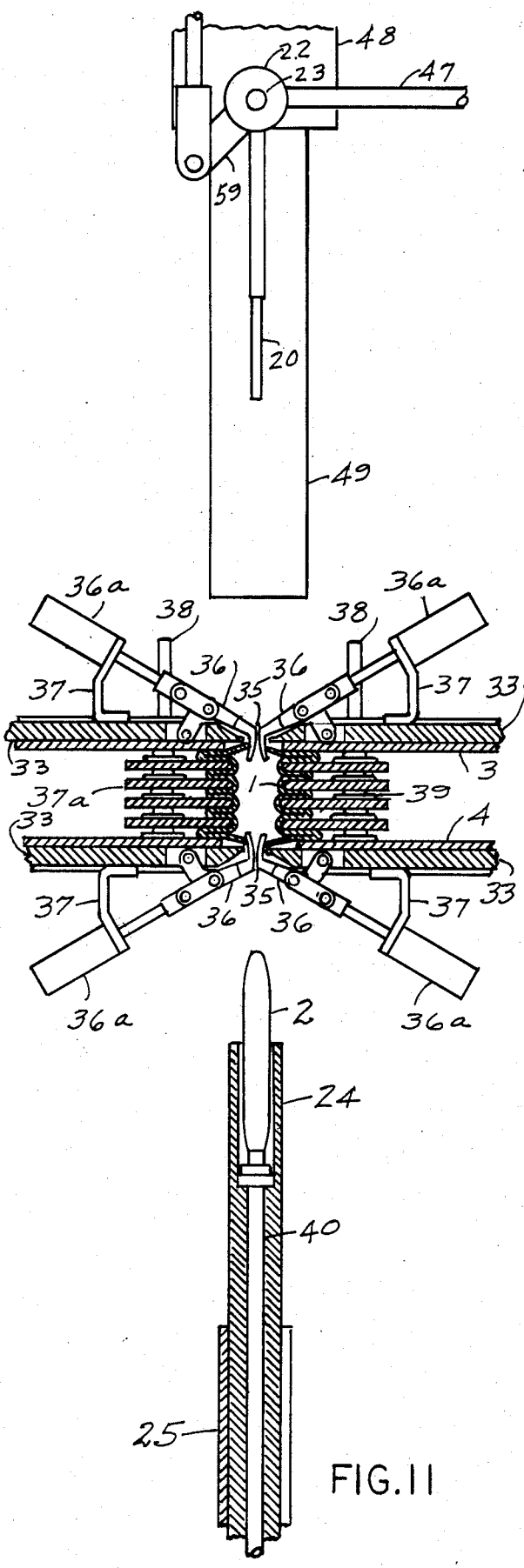
Figure 12:
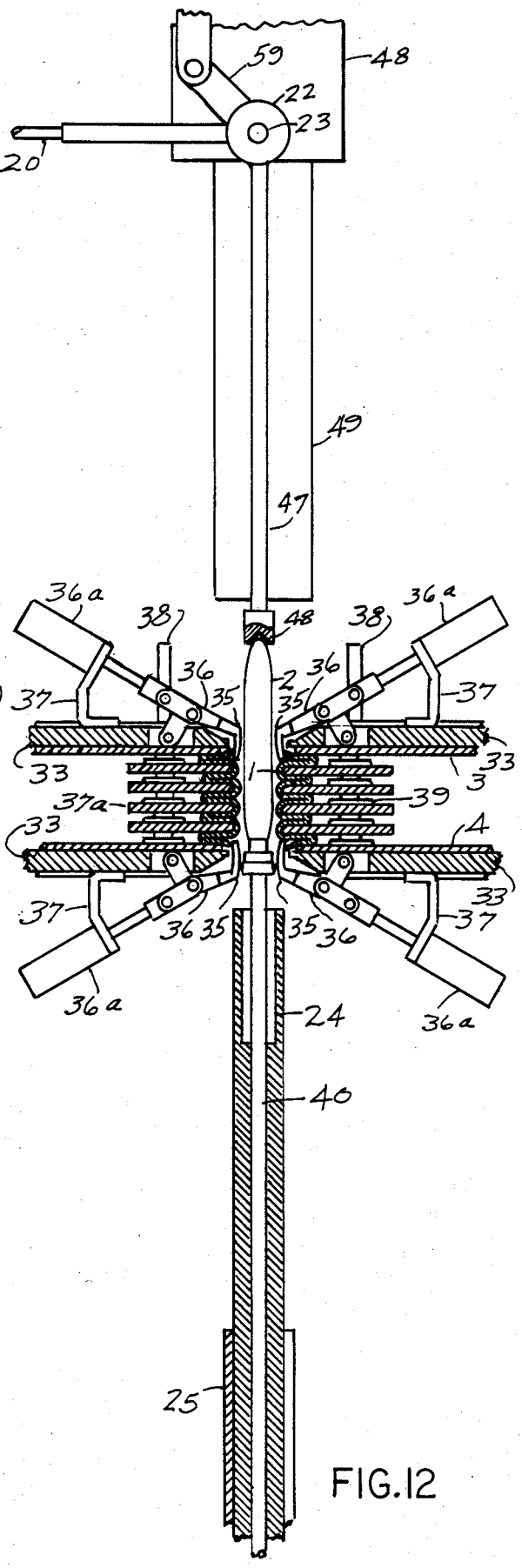

Refer to FIG. 11. The expansion of the elastic sleeve 1 may not be sufficient at the ends to allow the container 2 to enter properly, so prongs 35 are provided and actuated by the air cylinders 36*a* to penetrate the ends of elastic sleeve 1. Then the slide elements 33 are moved outwardly to stretch open the ends of the elastic sleeve 1. after which, the container is moved into the position shown in FIG. 12, by means of the ejector 40. At which time in the cycle, the cooperating ejector 47 is brought into position to properly center and position the container 2.

Figure 13:
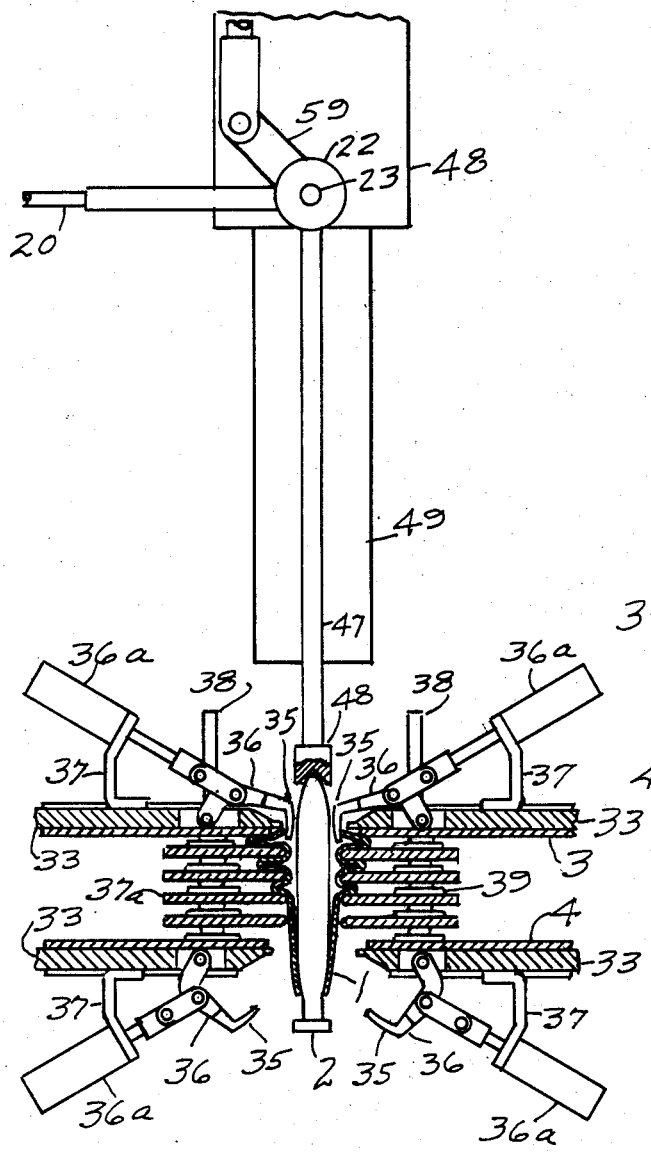
Figure 13:
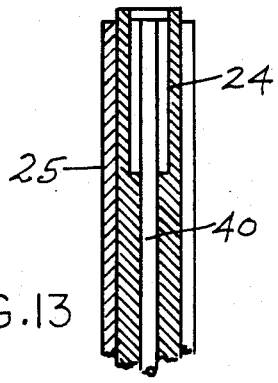
Figure 14:
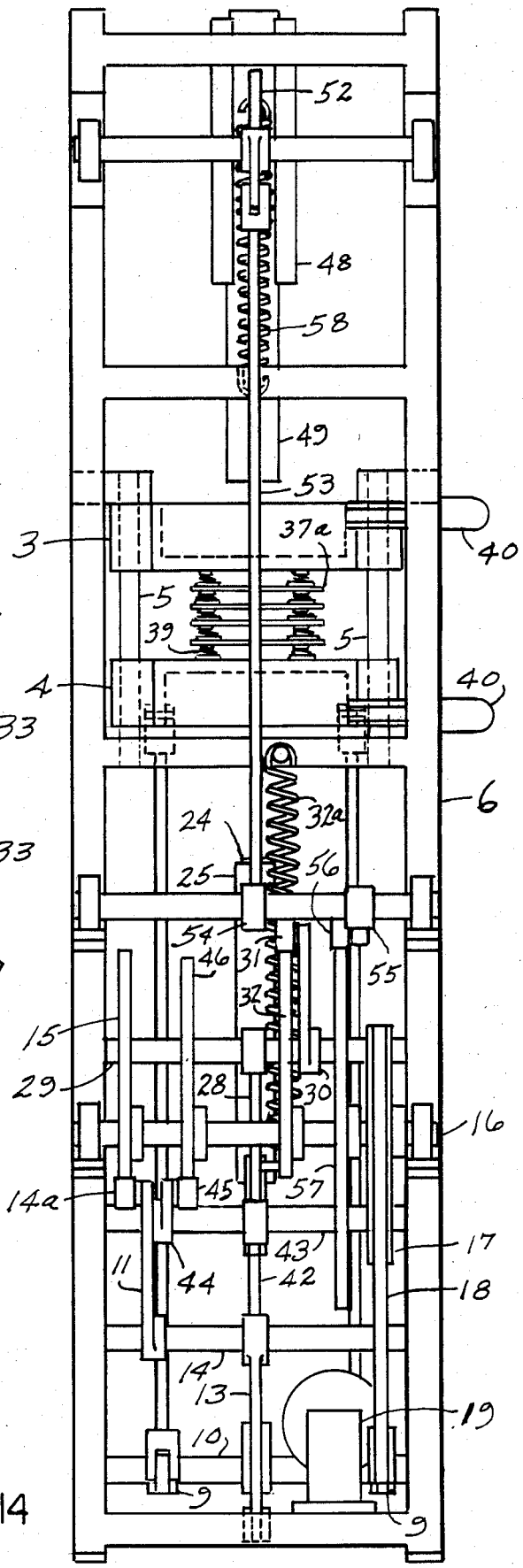
FIG. 14 is a side elevation view of the complete machine showing the actuation cams and motor drives.
Figures 15, 16, 17:
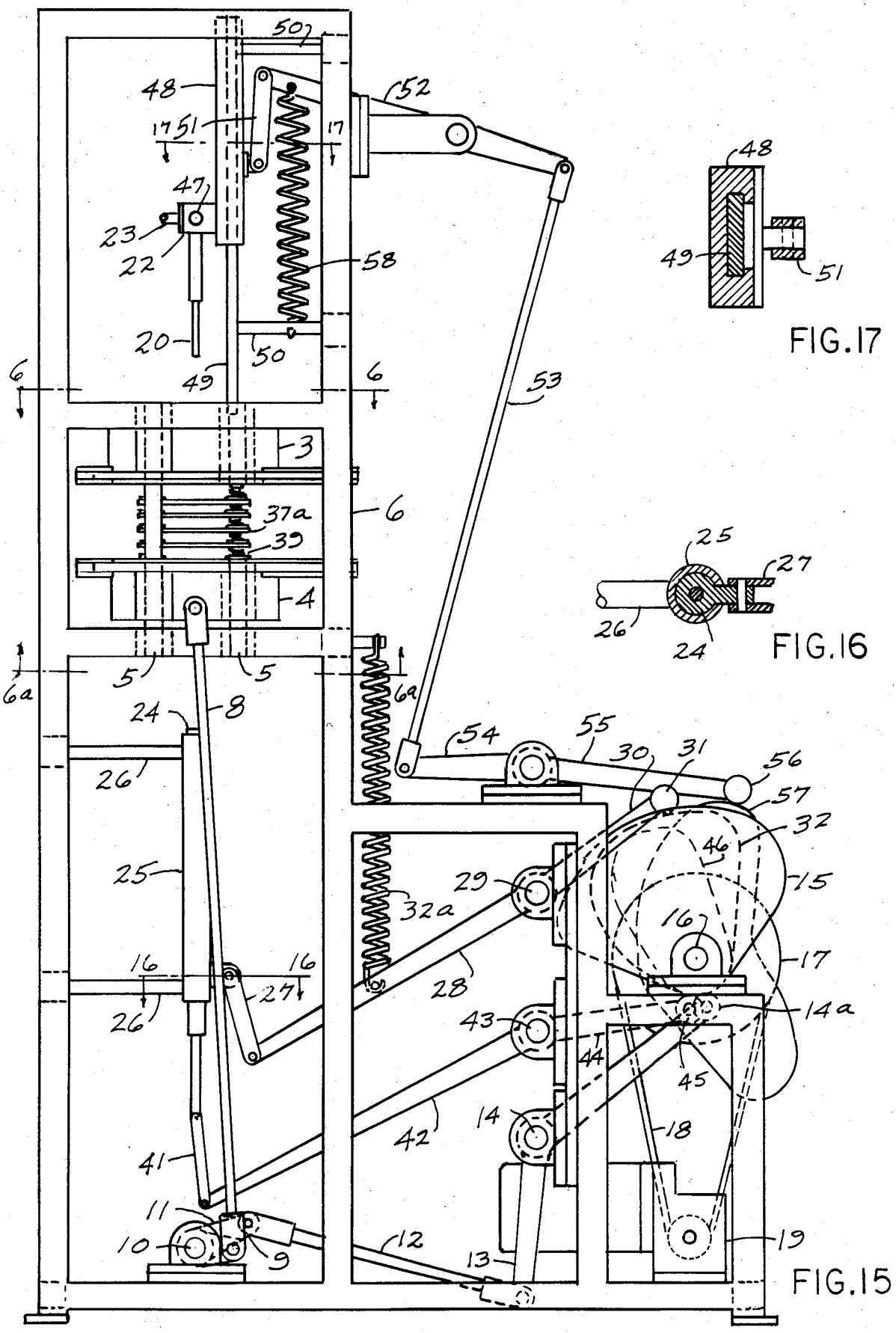
FIG. 15 is an elevation of the machine looking at the cam shaft end.
FIG. 16 is a small section taken on line 16, 16 of FIG. 15.
FIG. 17 is a small section taken on line 17, 17 of FIG. 15.

Refer to FIG. 13. The prongs 35 that are located in the lower plate 4 are next retracted by the respective air cylinders 36*a*, and the force on plate 4 is relaxed as controlled by cam 15, to allow parts of the elastic sleeve 1 to collapse on the container 2. The spiral springs 39 may be different strengths so as to allow parts of the elastic sleeve 1 to collapse progressively as the ejector 47 pushes the container 2 downward out of the location in the holes in the plates 39. Also, the tendency of the elastic sleeve 1 to return to its initial length will operate to spread the elastic sleeve 1 evenly lengthwise on the container 2.

When the container 2 with its applied elastic sleeve 1 has been pushed down sufficiently, it will fall free and ejector 40, being retracted to the position shown in FIG. 13, will prevent the container 2 from entering the receptacle 24. The container 2 will be ejected from the apparatus and may be directed to fall to a desired location (by means not shown).

The foregoing detailed description has been given for clearness of understanding only, and no unnecessary limitations should be understood therefrom, as modifications will be obvious to those skilled in the art.

I claim:

1. The method of applying an elastic sleeve to an article comprising the steps of:

causing an elastic sleeve to be pushed on an arbor that fits closely into the inside diameter of said sleeve; said arbor to extend lengthwise part way into the full length of the said elastic sleeve;

moving the said arbor with its said elastic sleeve into a location surrounded by a plurality of plates having holes of a size such as is required for expansion of the said elastic sleeve; said plates having their flat surfaces substantially perpendicular to the axis of the said arbor;

the said plates to be spaced apart in a direction of the axis of the said arbor;

causing the ends of the said elastic sleeve to be pinched to prevent leakage of fluid from the interior volume thereof;

providing fluid pressure to expand the said elastic sleeve large enough to contact the inner area of the said holes in said plates and to bulge into the spaces between the said plates;

reducing the spaces between the said plates to compress the bulges in the said elastic sleeve with enough force to provide frictional contact between the faces of said plates and the bulges of the said elastic sleeve so that there will be no loss of expansion of the said elastic sleeve when the said fluid pressure is released;

releasing the fluid pressure;

moving an article to which the said elastic sleeve is to be applied into position to receive the said elastic sleeve;

reducing the force applied to the said plates to allow the said elastic sleeve to collapse on the said article.

2. A method, as recited in claim 1, wherein a plurality of prongs are inserted into the ends of the said expanded elastic sleeve, and causing the said prongs to move in a direction away from the axis of the said arbor so as to increase the opening in the ends of the said elastic sleeve.

3. An apparatus for applying an elastic sleeve to an article comprising:

an arbor arranged to fit into the inside diameter of an elastic sleeve, said arbor to extend lengthwise partly through the length of the said elastic sleeve;

means for controlled movement of the arbor into a location;

a plurality of plates having holes of a size such as is required for the expansion of the said elastic sleeve;

said plates having their flat surfaces substantially perpendicular to the axis of the said arbor; said plates spaced apart and located so as to surround the aforesaid location of the elastic sleeve on its said arbor and spaced to cover approximately the length of the said elastic sleeve;

means for pinching the ends of the said elastic sleeve to prevent loss of fluid;

means for providing fluid pressure to the inside of the said elastic sleeve to expand the said elastic sleeve to a size large enough to contact the inside surface of the holes in the said plates and to cause the said expanded elastic sleeve to bulge into the spaces between the said plates;

means for moving the plates axially of the arbor to reduce the said spaces between said plates to compress the said bulges in said elastic sleeve with enough force to maintain the expansion of the said elastic sleeve when the fluid pressure is released;

means for releasing the fluid pressure;

means for moving an article into the interior of the said expanded elastic sleeve;

means for releasing the force acting on the said plates to allow the said elastic sleeve to collapse on the said article and means for discharging the said article with said elastic sleeve.

4. The apparatus of claim 3 wherein a plurality of prongs are provided for entering into the ends of the said expanded elastic sleeve and means for causing the said prongs to move in a direction away from the axis of said arbor to open the ends of the said elastic sleeve so as to allow the insertion of the said article.

5. A process for encasing a container in an open-ended, elastic sleeve comprising;

placing the sleeve in holding means for expanding said sleeve generally, and for permitting the even greater expansion of alternating, transverse, circular portions thereof along the sleeve's longitudinal axis to form parallel, circular ridges;

constricting the open ends of said sleeve and expanding the sleeve;

forming said circular ridges in said sleeve;

mechanically gripping said ridges in order to maintain them, and the rest of said sleeve in a distended condition;

thereafter expanding the ends of said sleeve and inserting a container therein, and releasing said ridges, thereby allowing the sleeve to contract compactly about said container.

6. A process according to claim 5 in which the expansion is accomplished by inflating the sleeve with pressured air introduced through a tubular arbor inserted through one of the constricted ends.

7. A process according to claim 5 in which the mechanical gripping is accomplished by compressing the circular ridges between elements of said holder.

8. A process according to claim 5 in which the expansion of the sleeve ends is accomplished by air-operated speculum means.

9. A process according to claim 8 wherein said speculum means comprises prong levers.

10. A process according to claim 5 in which said container is a plastic device having a corrugated cross-section, and said sleeve is an open-ended, elongated, elastomeric tube.

11. A process according to claim 10 in which said sleeve is fabricated from natural rubber.

12. A process according to claim 5 in which the constriction is accomplished by mechanically compressing the perimeters of the ends of said sleeve sufficiently to substantially avoid the escape of air therefrom.

13. An apparatus for encasing a container in an open-ended, elastic sleeve comprising:

means for holding said sleeve while permitting its expansion generally and the even greater expansion of alternating, transverse, circular portions thereof along the sleeve's longitudinal axis to form parallel, circular ridges;

means for constricting the open ends of said sleeve, and for expanding it by inflation;

means for forming said circular ridges in said sleeve;

means for mechanically gripping said ridges by compression, thereby maintained the ridges, and the rest of said sleeve intermediate its ends, in a distended condition;

means for expanding the ends of said sleeve, and means for inserting a container in said sleeve.

* * * * *